US006067928A

United States Patent [19]

Holzer, Jr. et al.

[11] Patent Number: 6,067,928

[45] Date of Patent: May 30, 2000

[54] FILAMENT GUIDE ASSEMBLY ESPECIALLY USEFUL IN COMBINATION WITH FILAMENT FINISH APPLICATORS

[75] Inventors: Carl R. Holzer, Jr., Anderson; Richard T. Phelps, III, Greenville; Gary W. Hanwell, Anderson; David L. Caldwell, Easley, all of S.C.

[73] Assignee: BASF Corporation, Mt. Olive, N.J.

[21] Appl. No.: 08/942,480

[22] Filed: Oct. 2, 1997

[51] Int. Cl.[7] ..... B05C 9/00

[52] U.S. Cl. ..... 118/33; 118/407; 118/420; 118/423; 118/428; 118/DIG. 18; 118/DIG. 19; 242/35.5 R; 242/157 R

[58] Field of Search ..... 118/33, 407, 420, 118/423, 428, DIG. 18, DIG. 19; 427/434.6, 434.7, 356; 242/35.5 R, 615, 615.2, 615.3, 157 R

[56] References Cited

U.S. PATENT DOCUMENTS

| | | | |
|---|---|---|---|
| 3,893,412 | 7/1975 | Louch et al. | 118/420 |
| 4,717,604 | 1/1988 | Justus | 427/434 |
| 4,759,960 | 7/1988 | Zaman | 427/356 |
| 4,973,006 | 11/1990 | James | 242/35.5 |
| 5,501,734 | 3/1996 | Oliphant | 118/234 |

*Primary Examiner*—Laura Edwards
*Attorney, Agent, or Firm*—Laura D. Nammo

[57] ABSTRACT

A filament guide assembly is provided with a support rod carrying a plurality of filament guides each for guiding a respective one of a plurality of filaments. A pair of support blocks mount the support rod at each end thereof to allow for (i) rotational movements between a raised position, wherein the filament guides are spaced from a respective one of the filaments, and a lowered position wherein the guides are in contact with the respective one of the filaments, and (ii) lateral shifting movements between an operative position, wherein the guides are aligned with the respective one of the filaments, and a rest position wherein the guides are laterally misaligned with the respective one of the filaments. Most preferably, the guide assembly is employed in combination with a finish oil applicator so that the guides bias the individual filaments into contact with finish oil nozzles thereof, and in so doing, ensure that positive contact between the finish oil nozzles and the filaments occurs.

14 Claims, 4 Drawing Sheets

FILAMENT GUIDE ASSEMBLY ESPECIALLY USEFUL IN COMBINATION WITH FILAMENT FINISH APPLICATORS

FIELD OF THE INVENTION

The present invention relates generally to the field of synthetic filament production. In preferred forms, the present invention is embodied in a synthetic filament guide system which may be used in combination with a finish nozzle and applicator assembly for applying a liquid finish material to the synthetic filaments.

BACKGROUND AND SUMMARY OF THE INVENTION

Synthetic filaments are traditionally produced by various spinning techniques. For example, synthetic filaments may be melt-spun by extruding a melt spinnable polymer through relatively small-sized orifices in a spin pack to form a stream of filaments that are substantially immediately solidified in a quench cabinet. The filaments are thereafter continuously taken up by a high speed winder to form a generally cylindrical package. Depending on the intended end use, the filaments may be flat (undrawn) or may be subjected to a drawing step prior to being taken up to form the package.

The solidified filaments are typically passed through a metered finish applicator, which applies a liquid finish material (colloquially referred to as a "finish oil") so as to lubricate the filaments to reduce filamentary friction and/or to achieve desired processability characteristics. Typically, a finish applicator mounting unit supports a plurality of finish applicator nozzles that each include a slot to receive the individual filament threadlines. A portion of the slot against which the filaments are guided includes a small opening for the finish oil. A pump supplies the finish oil at a pressure slightly above atmospheric. Thus, as the filaments pass through the finish applicator, the finish oil is coated onto the filaments During the start-up procedures for a conventional filament production line, the individual running threadlines are usually passed manually from one step in the filament production process to another step in the process as the production line is started. Such a procedure is colloquially referred to as "stringing-up" the process. The threadlines are passed in front of the finish applicators (or other devices) which eventually come into contact with the threadline. During "string-up" the threadlines are kept away from contacting the finish applicator (or other devices) until the process is set for continuous operation. At some point in the "string-up" operation, the threadlines are guided and held against the finish applicator. With multiple threadlines, this has usually been done by individually manually "threading" the filament bundle through a guide or by using a continuous bar. When a continuous bar is used, the threadlines must be passed between the bar and the applicators. With an individual guide, each filament must be handled separately. It is desirable to be able to provide an unobstructed area in front of and below the applicator to allow maximum room for "throw-down" (in a vertically oriented process the threadlines are "thrown down" a tube between floors in the process) and minimum obstruction.

The present invention provides a guiding system that is completely out of the way during "string-up". There are no obstructions to the front of the applicators thus allowing almost unlimited room for the "string-up" operation. When the guiding system is in place, it provides the advantages of individual guiding for each threadline while eliminating the need for manual positioning of each threadline as would be required in an individually guided design. The structures of the present invention thus include guides which have the ability to be removed from the operating area by rotating the guide system up and axially out of the way. A guide plate above the assembly provides the initial guiding necessary to get the threadline into the general vicinity of the applicator. It also covers the guide so that the threadline cannot come into contact with the guide, Broadly, therefore, the present invention is embodied in a filament guide assembly which is movable into a disengaged position relative to the thread lines. Specifically, the guide assembly of the present invention is movable between positions which respectively cause each of the threadlines to be disengaged from and engaged with a particular structure associated with the filament production process, for example, a respective finish oil applicator nozzle.

In particularly preferred embodiments, the filament guide assembly is provided with a support rod carrying a plurality of filament guides each for guiding a respective one of a plurality of filaments. A pair of support blocks mount the support rod at each end thereof to allow for (i) rotational movements between a raised position, wherein the filament guides are spaced from a respective one of the filaments, and a lowered position wherein the guides are in contact with the respective one of the filaments, and (ii) lateral shifting movements between an operative position, wherein the guides are aligned with the respective one of the filaments, and a rest position wherein the guides are laterally misaligned with the respective one of the filaments. Most preferably, the guide assembly is employed in combination with a finish oil applicator so that the guides bias the individual filaments into contact with finish oil nozzles thereof, and in so doing, ensure that positive contact between the finish oil nozzles and the filaments occurs.

These and other aspects and advantages of the present invention will become more clear after careful consideration is given to the following detailed description of the preferred exemplary embodiments thereof.

BRIEF DESCRIPTION OF THE ACCOMPANYING DRAWINGS

Reference will be made to the accompanying drawings, wherein like reference numerals throughout the various FIGURES denote like structural elements, and wherein.

DETAILED DESCRIPTION OF THE INVENTION

Figure 1:
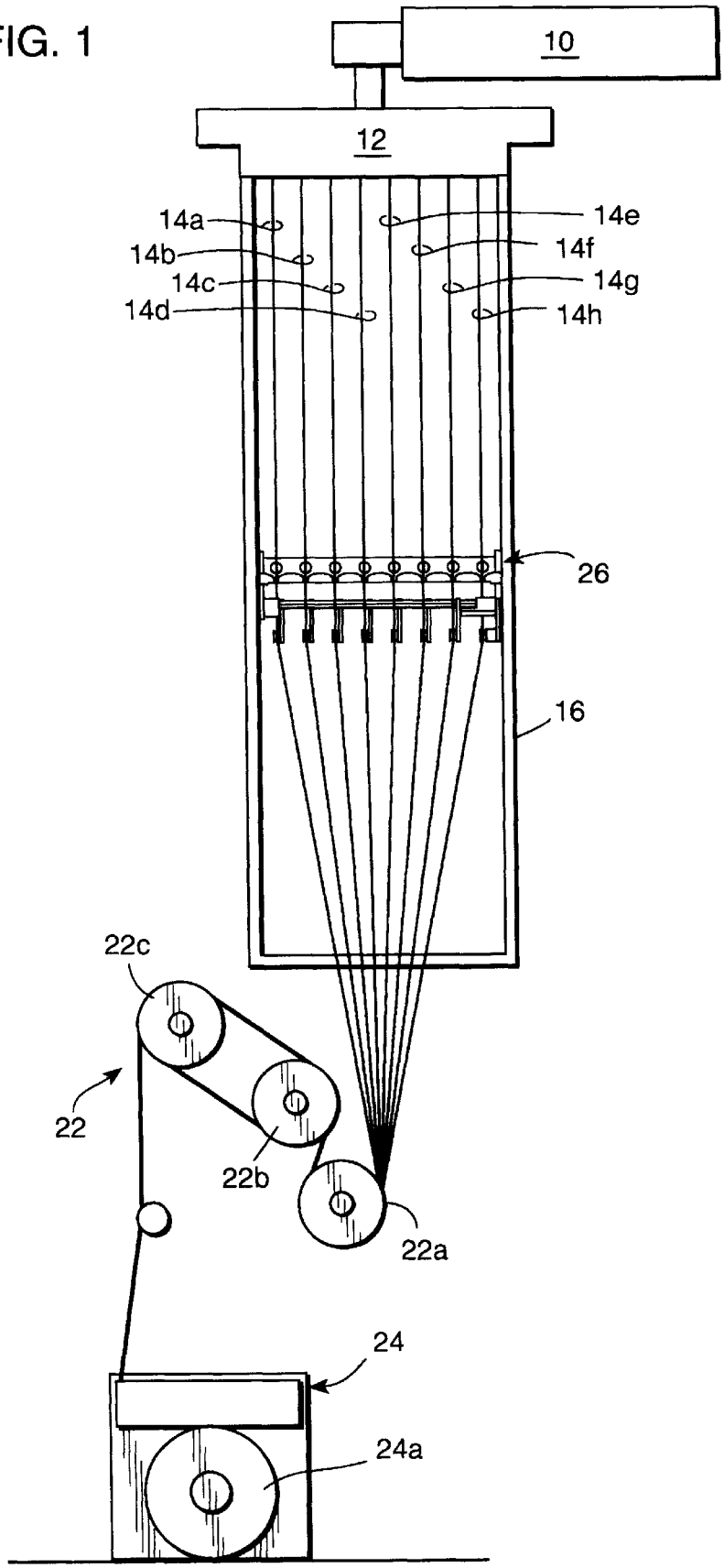
FIG. 1 is a schematic elevational view of an exemplary filament spinning system in which the guide assembly of the present invention may be employed.

In a typical melt spinning apparatus as shown in FIG. 1, an extruder 10 extrudes a polymer melt through a spin pack 12 having a plurality of spinneret orifices that form a plurality of filament threadlines 14*a*–14*h*. It will be understood that, depending on the intended end use, each of the threadlines may include a single filament or may include any number of filaments forming a yarn. The filament threadlines 14*a*–14*h* are first cooled in a quench cabinet 16 and may thereafter be drawn by a drawing assembly 22, comprised of godet rolls 22*a*–22*c*. The final product is then wound by a high speed winder 24 to form a package 24*a*. Prior to being taken up by the winder 24, each of the individual filament threadlines 14*a*–14*h* may be brought into contact with a finish applicator 26 so that finish oil may be applied. In this regard, the finish applicator 26 is most preferably provided with a downstream (e.g., in terms of the direction of travel of the filament threadlines 14*a*–14*h*) filament guide assembly 30 in accordance with the present invention.

Figure 2:
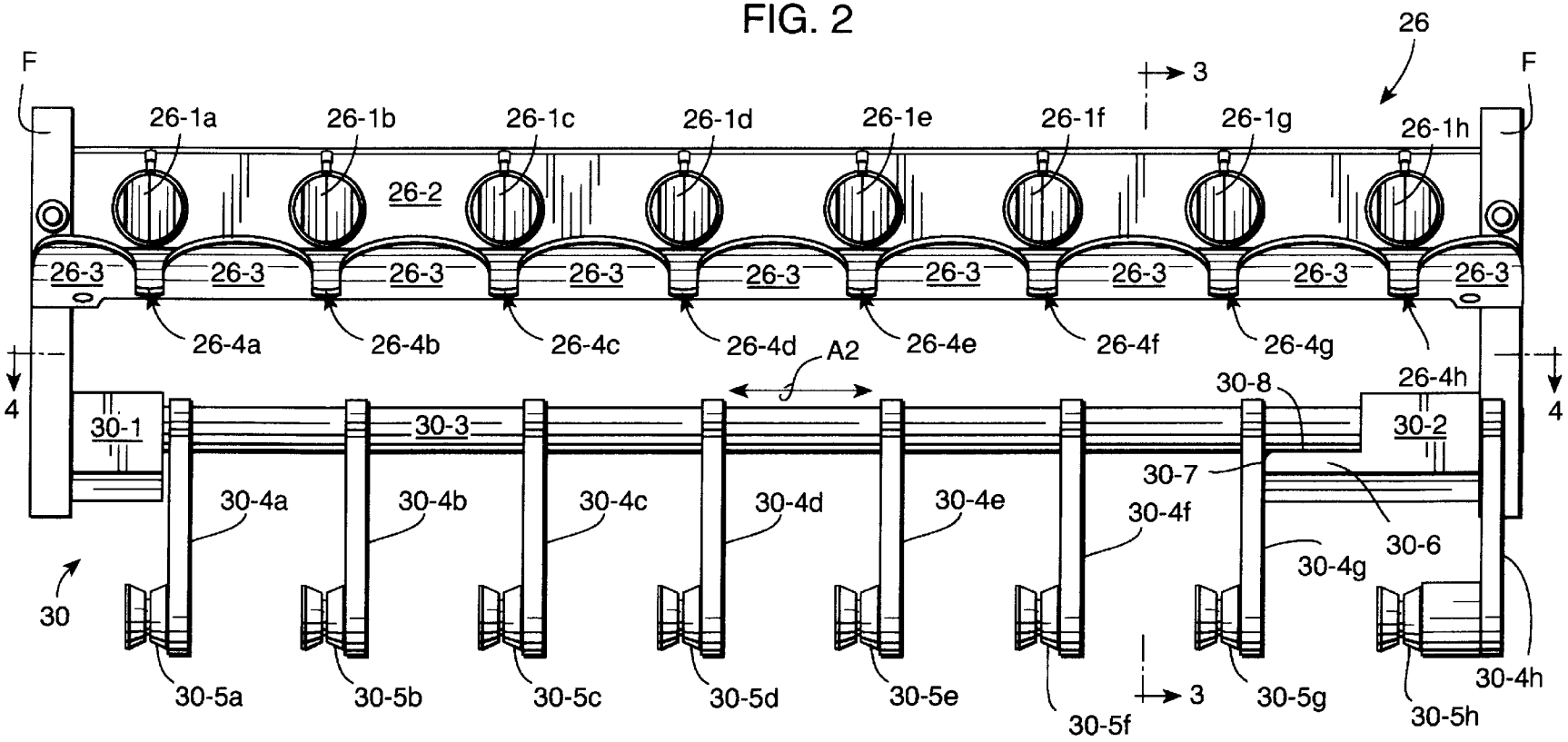
FIG. 2 is a front elevational view showing a guide assembly according to the present invention in combination with a finish oil applicator.
Figure 3:
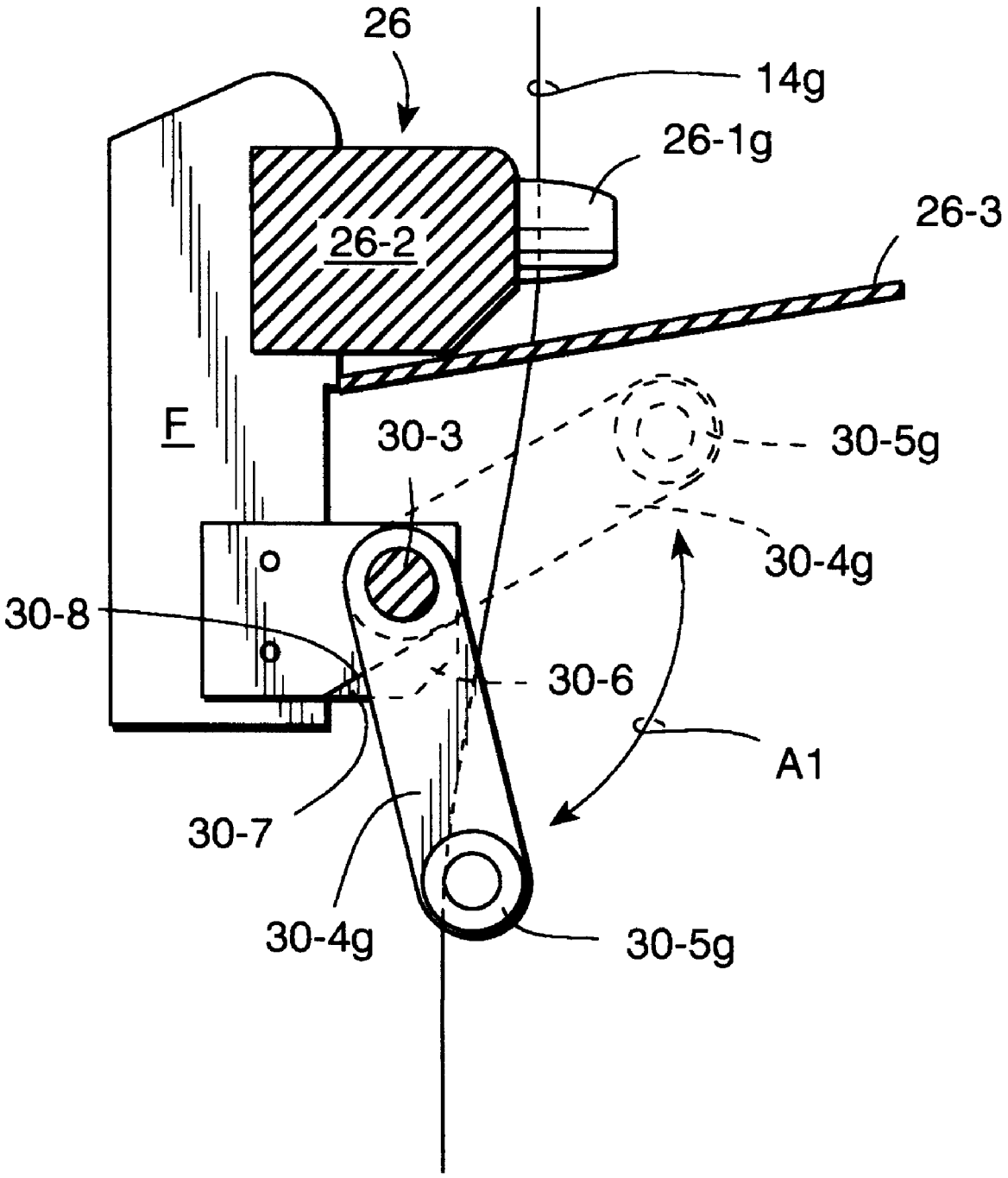
FIG. 3 is a cross-sectional elevational view of the guide assembly and finish oil applicator depicted in FIG. 2 as taken along line 3—3 therein.
Figure 4:
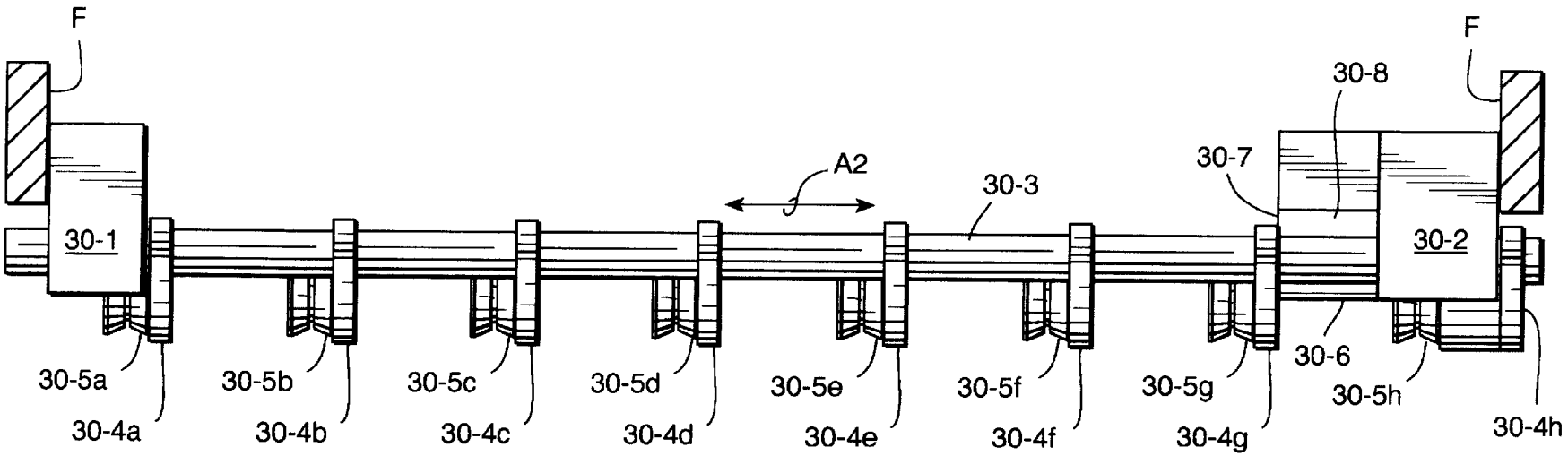
FIG. 4 is a plan view of the guide assembly depicted in FIG. 2 as taken along line 4—4 therein.

Accompanying FIGS. 2–4 perhaps more clearly show the filament guide assembly 30 in accordance with the present invention and its structural/functional relationship to the finish applicator 26. In this regard, it will be appreciated that the combination of the guide assembly 30 with a finish applicator represents a particularly preferred embodiment of the present invention. The filament guide assembly 30 could, however, be employed with other structural components associated with the filament spinning apparatus. Thus, although the discussion which follows will focus on the combination of the guide assembly 30 and a finish applicator 26, it should be realized that such a discussion is non-limiting to the present invention.

As is shown, the finish applicator 26 may be provided with a plurality of notched finish applicator nozzles 26-1*a* through 26-1*h* positioned in an elongate frame 26-2 which extends transversely relative to the threadlines 14 and is connected at each end thereof to frame members F. The applicator 26 also includes a plurality of fixed-position lower guide tabs 26-3 which define slots 26-4*a* through 24-6*h* therebetween aligned with the nozzles 26-1*a* through 26-1*h* and through which the individual respective threadlines 14*a*-14*h* pass. Most preferably, the finish applicator 26 is in accordance with U.S. patent application Ser. No. 08/616,478 filed on Mar. 19, 1996 (now U.S. Pat. No. 5,679,158), the entire content of which is expressly incorporated hereinto by reference.

The guide assembly 30 is generally positioned downstream of the nozzles 26-1 and slots 26-4 associated with the finish applicator 26 and is mounted to the frame members F substantially parallel to the elongate frame 26-2. In this regard, the guide assembly 30 includes a pair of support blocks 30-1, 30-2 which rotatably and slidably receive the axially elongate support rod 30-3. The support rod 30-3 is thus capable of rotational movements (arrow A1 in FIG. 3) about its longitudinal axis towards and away from the plane of the traveling threadlines 14 so as to assume lowered and raised positions (i.e., as shown by the solid and dashed line representations, respectively, in FIG. 3. In addition, however, the support rod 30-3 is also laterally shiftable in the direction of its longitudinal axis (arrow A2 in FIGS. 2 and 4).

The support rod 30-3 rigidly carries a plurality of guide arms 30-4*a* through 30-4*h* radially extending therefrom. Each of the guide arms 304*a* through 30-4*h*, in turn, is provided at its terminal end with a threadline guide roller 30-5*a* through 30-5*h* adapted to receive a respective one of the threadlines 14*a*–14*h*.

The support block 30-2 includes an outwardly protruding limit member 30-6 having an end surface 30-7 and an inclined planar resting surface 30-8. As noted previously, the support rod 30-3 is both rotational about, and laterally shiftable along, its longitudinal axis. Thus, when in its raised position, the individual filament guides 30-5*a* through 30-5*h* at the ends of the arms 30-4*a* through 30-4*h* will be spaced away from their individual threadlines 14*a*–14*h*, respectively. While in such a raised position, the support rod 30-3, and hence all of the guides 30-5*a* through 30-5*h* carried thereby, may be shifted laterally toward the support block 30-2 so that the arm 30-4*g* may be brought to bear against the rest surface 30-8. That is, when the support rod 30-3 is in its raised position and shifted laterally (i.e., in a rightward direction as viewed in FIGS. 2 and 4), the weight of the guides 30-5*a* through 30-5*h* will cause the arm 30-4*g* to be rotatably brought by gravity into contact with the rest surface 30-8. As such, the individual guides 30-5*a* through 30-5*h* will, in turn, be shifted laterally out of alignment with the nozzles 26-1*a* through 26-1*h* and their respective threadlines 14*a*–14*h*. While in such a position, the threadlines 14*a*–14*h* will naturally assume a position wherein they are spaced outwardly from a respective one of the nozzles 26-1*a* through 26-1*h*.

When the support rod 30-3 is shifted laterally out of its rest position and allowed to rotate into its operative position, however, each of the guides 30-5*a* through 30-5*h* will bear against a respective one of the threadlines 14*a*–14*h*. The weight of the guides 30-5*a* through 30-5*h* will thus cause each of the threadlines to be biased into positive engagement with the finish oil nozzles 26-1*a* through 26-1*h* so as to ensure that finish oil may be reliably applied thereto. While in its operative position, the limit surface 30-7 thus retains the guides 30-5*a* through 30-5*h* in alignment with each of their respective threadlines 14*a*–14*h*.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A filament guide assembly comprising:

a support rod carrying a plurality of filament guides each for guiding a respective one of a plurality of filaments;

a pair of support blocks which mount said support rod at each end thereof to allow for (i) rotational movements between a raised position, wherein said filament guides are spaced from a respective one of the filaments, and a lowered position wherein said guides are in contact with said respective one of the filaments, and (ii) lateral shifting movements between an operative position, wherein said guides are aligned with said respective one of the filaments, and a rest position wherein said guides are laterally misaligned with said respective one of the filaments.

2. The guide assembly of claim 1, wherein one of said support blocks defines a rest surface against which one of said filament guides bears when in said rest position so as to maintain said support rod in said rest position.

3. The guide assembly of claim 1 or 2, wherein each of the guides includes a guide arm having one end fixed to said support rod and radially extending therefrom, and a guide roller attached to an opposite end of said guide arm.

4. The guide assembly of claim 3, further comprising a limit surface against which one of said guide arms bears when said support rod is in said operative position for maintaining said support rod in said operative position.

5. A filament treating apparatus comprising:

(a) a filament guide assembly comprising:

(i) a support rod carrying a plurality of filament guides each for guiding a respective one of a plurality of filaments;

ii) a pair of support blocks which mount said support rod at each end thereof to allow for (i) rotational movements between a raised position, wherein said filaments guides are spaced from a respective one of the filaments, and a lowered position wherein said guides are in contact with said respective one of the filaments, and (ii) lateral shifting movements between an operative position, wherein said guides are aligned with said respective one of the filaments, and a rest position wherein said guides are laterally misaligned with said respective one of the filaments; and (b) a finish oil applicator, wherein said guide assembly is positioned downstream of said applicator.

6. The apparatus of claim 5, wherein one of said support blocks defines a rest surface against which one of said filament guides bears when in said rest position so as to maintain said support rod in said rest position.

7. The apparatus of claim 5 or 6, wherein each of the guides includes a guide arm having one end fixed to said support rod and radially extending therefrom, and a guide roller attached to an opposite end of said guide arm.

8. The apparatus of claim 7, further comprising a limit surface against which one of said guide arms bears when said support rod is in said operative position for maintaining said support rod in said operative position.

9. The apparatus of claim 5, wherein said finish oil applicator includes a plurality of finish oil nozzles, and wherein each of said guides bias said filaments into contact with a respective one of said finish oil nozzles.

10. A filament treating apparatus comprising:

a finish oil applicator having a plurality of finish oil nozzles each for applying finish oil to a respective traveling filament; and a filament guide assembly including, (a) a rotatable support rod;

(b) a plurality of guide arms fixed at one end to said support rod and radially extending therefrom; and (c) a plurality of guide rollers each attached to another end of a respective one of said guide arms; wherein (d) said support rod rotates so that said guide rollers biasingly urge each of said traveling filaments into contact with a respective one of said finish oil nozzles.

11. The apparatus of claim 10, wherein said guide assembly includes a support block coupled to said support rod to allow for (i) rotational movements between a raised position, wherein said filament guides are spaced from a respective one of the filaments, and a lowered position wherein said guides are in contact with said respective one of the filaments, and (ii) lateral shifting movements between an operative position, wherein said guides are aligned with said respective one of the filaments, and a rest position wherein said guides are laterally misaligned with said respective one of the filaments.

12. The apparatus of claim 11, wherein said support block defines a rest surface against which one of said filament guides bears when in said rest position so as to maintain said support rod in said rest position.

13. The apparatus of claim 12, further comprising a limit surface against which one of said guide arms bears when said support rod is in said operative position for maintaining said support rod in said operative position.

14. The apparatus of claim 11, comprising a pair of said support blocks.

* * * * *